US005827412A

United States Patent [19]

Shimamune et al.

[11] Patent Number: 5,827,412

[45] Date of Patent: Oct. 27, 1998

[54] LIQUID PERMEATION-TYPE GAS-DIFFUSION CATHODE

[75] Inventors: Takayuki Shimamune, Tokyo; Shuhei Wakita, Kanagawa; Takahiro Ashida, Kanagawa; Masashi Tanaka, Kanagawa; Yoshinori Nishiki, Kanagawa, all of Japan

[73] Assignee: Permelec Electrode Ltd., Kanagawa, Japan

[21] Appl. No.: 881,361

[22] Filed: Jun. 24, 1997

[30] Foreign Application Priority Data

Jun. 26, 1996 [JP] Japan ..... 8-185488

[51] Int. Cl.[6] ..... C25B 1/00

[52] U.S. Cl. ..... 204/252; 204/282; 204/283

[58] Field of Search ..... 204/252, 282, 204/283, 630

[56] References Cited

U.S. PATENT DOCUMENTS 5,676,808 10/1997 Nishiki et al. ..... 204/252

5,693,213 12/1997 Shimamune et al. ..... 205/525

*Primary Examiner*—Bruce F. Bell

*Attorney, Agent, or Firm*—Sughrue, Mion, Zinn, Macpeak & Seas, PLLC

[57] ABSTRACT

A liquid-permeable gas-diffusion cathode adapted for caustic soda electrolysis in contact with an ion-exchange membrane partitioning an electrolytic cell into an anode chamber and a cathode gas chamber. Plural horizontal concave grooves and/or convex portions are provided in an interval with one another on the surface of the gas-diffusion cathode facing the gas chamber. Plural vertical concave grooves may also be provided in an interval on the surface of the cathode crossing the horizontal grooves and/or convex portions. Aqueous caustic soda solution thus formed flows downward along the grooves, etc., without covering other portions of the cathode surface, and is easily released therefrom without clogging perforations in the gas-diffusion layer of the cathode.

9 Claims, 2 Drawing Sheets

LIQUID PERMEATION-TYPE GAS-DIFFUSION CATHODE

FIELD OF THE INVENTION

The present invention relates to a gas-diffusion cathode capable of removing electrolytic product with good efficiency. More specifically, the present invention relates to a gas-diffusion cathode which is preferably used for soda electrolysis and which easily releases caustic soda formed on the surface thereof.

BACKGROUND OF THE INVENTION

The electrolytic industry represented by chloroalkali electrolysis plays an important role as a material producing industry. Although chloroalkali electrolysis has such an important role, a large amount of energy is consumed in conducting chloroalkali electrolysis. Thus, in countries where the energy cost is high, such as in Japan, it is important to reduce energy consumption. For example, in chloroalkali electrolysis, for resolving environmental problems and reducing energy consumption, the electrolysis has been converted from a mercury method to an ion-exchange membrane method employing a diaphragm. After about 25 years, an energy savings of about 40% has been achieved. However, even the energy savings achieved by employing an ion-exchange membrane method is insufficient, and the cost of electric power which is the energy required for the ion-exchange membrane method is 50% of the total production cost. However, as far as the above-described method is used, additional electric power savings is impossible. For further reducing energy consumption, a radical change such as a charge in the electrode reaction must be considered. As an example, the use of a gas diffusion electrode employed in fuel cells, etc., is the means having the highest potential for saving electric power at present.

In a conventional anodic reaction (1) using a gas-diffusion electrode in place of a metal electrode as the anode, the anodic reaction (1) below is converted to the anodic reaction (2) as follows.

$$2\ NaCl+2\ H_2O \rightarrow Cl_2+2\ NaOH+H_2\quad E_0=2.21\ V \tag{1}$$

$$2\ NaCl+1/2\ O_2+H_2O \rightarrow Cl_2 2\ NaOH\quad E_0=0.96\ V \tag{2}$$

That is, by converting a metal electrode to a gas-diffusion electrode, the potential is reduced from 2.21 V to 0.96 V, such that an energy savings of about 65% becomes theoretically possible. Accordingly, various investigations have been conducted for the chloroalkali electrolysis using a gas-diffusion electrode.

The gas-diffusion electrode is generally semi-hydrophobic (water-repellent) and a hydrophilic reaction layer carrying platinum, etc., on the surface thereof is connected to a hydrophobic gas-diffusion layer. Both the reaction layer and the gas-diffusion layer employ a polytetrafluoroethylene (PTFE) resin, and by utilizing the properties of the PTFE resin, both layers of the gas-diffusion electrode are formed such that a large proportion of the resin is contained in the gas-diffusion layer and the reaction layer contains a reduced proportion of the resin.

When such a gas-diffusion electrode is used for chloroalkali electrolysis, various problems occur. For example, in a high concentration aqueous caustic soda (sodium hydroxide) solution, the PTFE resin, which is a water repellent material, is liable to become hydrophilic and loses its water-repellency. To prevent the PTFE resin from losing its water repellency, a thin porous PTFE resin sheet can be applied to the foregoing gas-diffusion layer at the gas chamber side. Also, the electrolysis is carried out while supplying oxygen gas or air to the gas-diffusion electrode. However, in this case, hydrogen peroxide is partially formed as a side reaction product, and the hydrogen peroxide tends to corrode carbon which is a constituent material of the gas-diffusion electrode to form sodium carbonate. Furthermore, in an aqueous alkali solution, the foregoing sodium carbonate precipitates to sometimes clog the gas-diffusion layer and render the surface of the gas-diffusion layer hydrophilic, such that the function of the gas-diffusion electrode is deteriorated. Also, even when sodium carbonate is not formed, it is observed that by carrying a catalyst on the carbon surface, the carbon is corroded with the catalyst.

To solve the above-described problems, the selection of various kinds of carbon, the production method thereof, and control of the mixing ratio of carbon and the resin have been investigated. However, these methods cannot essentially solve the above-described problems. That is, in accordance with these methods, the corrosion of carbon can be delayed but the corrosion cannot be prevented.

Because corrosion problem does not occur when carbon is not used, various proposals have been made to use silver in place of carbon. However, a gas-diffusion electrode based on a metal is produced by a sintering method different from a gas-diffusion electrode using carbon as a constituent material, and the production method thereof is very complicated. Furthermore, it is difficult to control the respective hydrophilic and hydrophobic portions.

As a method of solving these problems and further lowering the electrolytic voltage, a method of adhering or connecting a gas-diffusion electrode to an ion-exchange membrane to substantially omit the cathode chamber, or in other words, a method of configuring the cathode chamber as a gas chamber, has been proposed in, for example, U.S. Pat. No. 4,578,159. When a chloroalkali electrolysis is carried out using an electrolytic cell employing the foregoing method, caustic soda thus formed reaches the gas chamber, which is a cathode chamber, through the reaction layer and the gas-diffusion layer. Because a catholyte is not present, the foregoing method is advantageous in that it does not effect the pressure difference in the height direction of the gas chamber. Thus, when the electrolytic cell is large-sized, it is unnecessary to consider the pressure distribution. Also, the electric resistance is minimized due to the substantial absence of the catholyte, whereby the electrolytic voltage can be maintained at a minimum. On the other hand, because the permeation of caustic soda in the gas chamber direction is accelerated, the size and size distribution of the perforations in the gas-diffusion layer must be controlled. Furthermore, the caustic soda which permeates to the gas chamber side tends to clog the perforations of the gas-diffusion layer such that the smooth progress of the electrolysis is hindered. This is not a problem on a laboratory scale, but in a large-sized electrolytic cell such as a practically-used electrolytic cell, the electric current distribution tends to become nonuniform due to clogging of the perforations as described above, and the electrolytic voltage is increased. That is, clogging of the perforations of the gas-diffusion layer becomes the largest obstruction for achieving large scale electrolysis.

Also, the same problems are indicated in a soda electrolysis such as a Glauber's salt electrolysis, etc., in addition to ordinary sodium chloride electrolysis.

SUMMARY OF THE INVENTION

It is therefore an object of the present invention to solve the above-described problem of the prior art, namely, the problem that a gas-diffusion electrode cannot be used at a practical level for an electrochemical reaction such as a sodium chloride electrolysis, a Glauber's salt electrolysis, etc., and to provide a liquid permeation-type gas-diffusion cathode for sodium chloride electrolysis, etc., that can be stably used for a long period of time even under severe conditions such as encountered in an alkali solution, etc.

That is, the present invention provides a liquid permeation gas-diffusion cathode in contact with an ion-exchange membrane partitioning an electrolytic cell into an anode chamber and a cathode gas chamber, wherein at least one of plural horizontal concave grooves and convex portions are provided in an interval with one another on the surface of the cathode facing the gas chamber. Furthermore, in a preferred embodiment, in addition to the plural horizontal concave grooves and/or convex portions, plural vertical concave grooves and/or convex portions are provided on the cathode surface in an interval wider than the interval of the plural horizontal concave grooves and/or convex portions. The vertical concave grooves and/or convex portions cross the plural horizontal concave grooves and/or convex portions.

DETAILED DESCRIPTION OF THE INVENTION

Figure 1:
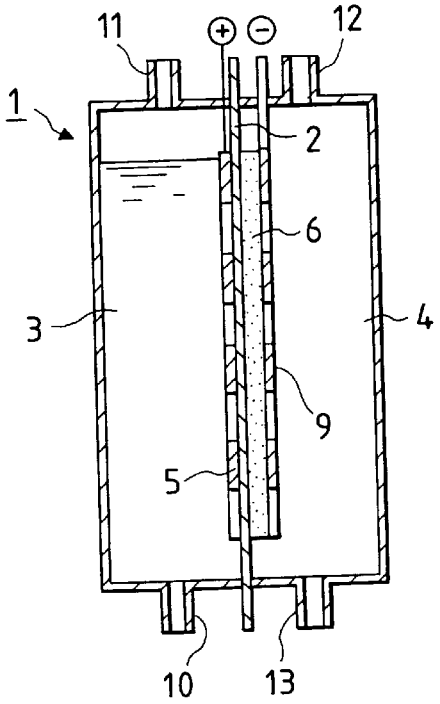
FIG. 1 is a schematic cross-sectional view showing an example of an electrolytic cell for soda electrolysis using the gas-diffusion cathode of the present invention.

The present invention is described in detail below.

The present invention provides a gas-diffusion cathode which can quickly release caustic soda, etc., permeating the cathode gas chamber when used in an industrial electrolysis such as a sodium chloride electrolysis, a Glauber's salt electrolysis, etc., from the surface of the gas-diffusion cathode, to thereby restrain instability in electrolytic conditions due to inadequate gas supply and conversion to a hydrophilic property. As a result, the gas-diffusion cathode can be used to carry out a soda electrolysis, etc., under stable conditions for a long period of time.

It is considered that the release of caustic soda solution from the surface of the gas-diffusion cathode can be smoothly carried out by making the surface thereof water repellent, that is, by reducing the wetting property of the gas diffusion electrode.

However, by only simply making the surface of the gas-diffusion cathode water repellent, a reduction in the wetting property of the surface can be attained. However, the solution which reaches the gas chamber side by permeating through the gas-diffusion layer remains on the surface of the gas-diffusion layer as water drops, and the water drops do not release from the surface without becoming considerably larger. The present inventors found that when the surface is smoother, the water drops become harder to release. On the contrary, when unevenness is formed on the surface, the present inventors found that the water drops easily release from the surface before growing large and do no cover the surface of the electrode.

As described above, in a soda electrolysis using, for example, a gas-diffusion cathode, with progress of the electrolysis, the caustic soda solution, which is a catholyte, permeates to the back surface of the gas-diffusion cathode. The caustic soda solution contains sodium ion which has permeated through the ion-exchange membrane from the anode chamber side, water, and hydroxide ion supplied from the cathode. If the aqueous caustic soda solution is not quickly removed from the surface of the gas-diffusion cathode, the perforations of the gas-diffusion cathode are clogged to hinder the gas supply such that stable electrolytic operation cannot be continued. In particular, a large amount of aqueous caustic soda solution is retained at the lower portion of the gas-diffusion cathode, that is, the lower side of the cathode along the gravity direction. This is because an aqueous caustic soda solution is added from the upper portion to increase the apparent overvoltage such that the voltage is increased.

In this case, when plural horizontal grooves are present on the surface of the gas-diffusion cathode, the solution flows along the grooves in the horizontal direction. As a result, the extent of clogging of the perforations of the gas-diffusion layer is reduced to restrain an increase in voltage and stable electrolytic operation becomes possible. That is, when narrow grooves are formed on the surface of the gas-diffusion cathode, for example, by pressing, the pressed portions are clogged to reduce the electrolytic area. However, because the aqueous caustic soda solution which permeates through the gas-diffusion cathode gathers in the concave grooves and flows along the concave grooves, clogging of the perforations of the gas-diffusion cathode is reduced to a greater extent than the reduction of electrolytic area due to pressing as described above. That is, because the aqueous caustic soda solution which permeates onto the surface of the gas-diffusion cathode flows along the foregoing concave grooves, the aqueous caustic soda solution does not restrain at least the surface of the gas-diffusion cathode below the concave grooves. As a result, gas is adequately supplied to allow the electrolysis to proceed at a low voltage. Thus, as the whole, the increase of voltage can be minimized and stable electrolytic operation can be carried out. In addition, the above-described concave grooves may be formed on the surface of the gas-diffusion cathode by molding the gas-diffusion cathode using a mold having projections corresponding to the foregoing concave grooves.

Depending upon the width and depth of each of the concave grooves and the amount of the aqueous caustic soda solution, the solution retained in the concave grooves at times moves downward from both end portions of the gas-diffusion cathode. This occurs when the width of the gas-diffusion cathode is small. Even when the width of the gas-diffusion cathode is sufficiently large, the solution retained in the above-described concave groove can overflow downwards.

To restrain the downward flow of the solution, in addition to arranging concave grooves in the horizontal direction, concave grooves in the vertical direction may be formed on the surface of the gas-diffusion cathode as described above. In this case, the solution flowing along a concave groove in the horizontal direction changes its direction of flow to the downward direction at a cross point with a concave vertical groove, flows along the concave vertical groove, and reaches the cross point under the above-described horizontal concave groove. Then, the solution flows in the horizontal direction along the concave horizontal groove or further flows downward along the foregoing concave vertical groove, and reaches the next horizontal concave groove. By repeating this flow pattern, the aqueous caustic soda solution, etc., which permeates to the surface of the gas-diffusion cathode is removed from the surface of the gas-diffusion cathode without overflowing or downward flowing from the end portions of the gas-diffusion cathode. The above-described concave grooves in the vertical direction prevent overflowing, etc., of solution retained in the above described horizontal concave grooves, and the number of concave vertical grooves may be less than the number of the horizontal concave grooves.

As described above, the portions having the above-described concave grooves cannot be utilized for the electrolysis, but the reduction of the electrolysis is sufficiently compensated by the increase in efficiency of the electrolysis. For example, when the horizontal concave grooves are formed in an interval of 5 cm and the concave grooves in the vertical direction are formed in an interval of 10 cm, the same performance as an electrolytic cell containing many electrodes each having a size of about 5 cm×10 cm is obtained. The interval of the horizontal concave grooves is generally from 2 to 25 cm, and the interval of the vertical concave grooves is generally from 5 to 50 cm.

The reduction of the electrode area is greatly influenced by the width of each concave groove. For minimizing the non-electrolytic area, the width of each of the foregoing concave grooves desirably is as small as possible in a range sufficient to retain the aqueous caustic soda solution and the width thereof is preferably in the range of from 2 to 3 mm. Also, there is no particular restriction on the depth of the concave groove, but the depth thereof preferably is about 50% of the thickness of the gas-diffusion cathode although the depth may be deeper than the above value. In this case, the ratio of the areas of the concave grooves to the surface area of the gas-diffusion cathode, or in other words, the ratio of the portions which do not function as the electrode, is from 6 to 9%. By the above relatively small reduction in electrode area, gas supply, etc., can be smoothly carried out for the remaining 91 to 94% of the surface of the gas-diffusion cathode and normal electrolytic operation becomes possible. Also, because the increase in voltage with an increase of the real current density by forming the concave grooves is from 10 to 30 mV or less, a gas-diffusion cathode having the concave grooves can be put to practical use.

In place of or together with the concave grooves described above, convex portions may be formed on the surface of the gas-diffusion cathode. The method of forming the convex portions is not particularly limited. For example, metal wires may be disposed in the vicinity of the surface of the thickness of the gas-diffusion cathode to expand the thickness of the gas-diffusion cathode material, or the convex portions may be formed on the surface of the gas-diffusion cathode by molding the gas-diffusion cathode with a mold having concave portions corresponding to the foregoing convex portions. The protection height of the convex portions is generally about 0.1 to 1 mm.

There is no particular restriction on the method of disposing metal wires on the surface of the gas-diffusion cathode. For example, the cathode base material can constitute a nickel or silver wire mesh or a metal wire mesh thickly plated with nickel or silver. By previously installing mesh metal wires thicker than the foregoing mesh with an interval of from 5 to 15 cm, a cathode having metal wires can be formed from the start. In addition, as a matter of course, the above-described metal wires are made of a material which is corrosion resistant to an electrolyte and if possible, the same material as the base material metal of the cathode is used.

Because the solution flowing down from above is stopped at the above described convex portions and does not flow downward from the convex portions, the solution flows along the foregoing convex portions and the same effect as provided by the concave grooves is obtained. Because solution gathers at the portions in which the metal wires are disposed, those portions do not contribute to the electrolysis similar to the concave grooves, but the increase in efficiency of the electrolysis in portions other than the convex portions sufficiently supplements the reduction of the electrode area. In addition, convex portions crossing the convex portions in the horizontal direction may be formed in the vertical direction and the solution may flow down along the convex portions in the vertical direction as in the case of the concave grooves described above. However, the solution which overflows from the convex portions moves downward (falls) without contacting the gas-diffusion cathode below the convex portions. Thus, the possibility of clogging the gas-diffusion cathode with the solution is low and the above-described convex portions in the vertical direction may not be needed. However, for example, cutting horizontal wires (convex portion) at the crossing point with vertical grooves (concave portion) is preferred. This is because a part of the solution retained at the metal wire portion (convex portion) moves along the metal wire and another part of the solution flows downward through the groove from the cut portion of the metal wire. Thus, even in the case of a large-sized electrolytic cell, electrolysis without current distribution over the entire surface of the gas-diffusion cathode becomes possible.

By using a gas-diffusion cathode having the above described construction and other constituent members, an electrode structural material prepared by laminating in the order of an anode-an ion-exchange membrane-the gas-diffusion cathode-a cathode feeder and the electrode structural material can be incorporated into an electrolytic cell. Then, while supplying an aqueous solution to the anode chamber and an oxygen-containing gas to the cathode chamber of the electrolytic cell, electric current is passed between both electrodes, cathodic products such as an aqueous caustic soda solution, etc., are formed at the gas-diffusion cathode, and the aqueous caustic soda solution permeates the foregoing gas-diffusion cathode and reaches the surface of the gas-diffusion cathode. The aqueous caustic soda, etc., contacts the concave grooves and/or the convex portions formed on the surface of the gas-diffusion cathode, moves along the concave grooves and/or the convex portions in the horizontal direction or the vertical direction on the surface of the gas-diffusion cathode, finally reaches the lower end of the gas-diffusion cathode, is released from the gas-diffusion cathode, and is removed from the electrolytic cell.

In the gas-diffusion cathode of the present invention, the electrode surface portions having concave grooves and/or convex portions do not function as an electrode and thus the effective electrode area is reduced. However, in a gas-diffusion cathode not having concave grooves, etc., as described above, an aqueous caustic soda solution, etc., is present at the entire surface of the gas-diffusion cathode and the gas-diffusion cathode tends to become clogged with the caustic soda solution, etc. On the other hand, in the gas-diffusion cathode of the present invention, the aqueous caustic soda solution, etc., permeates to those portions where the above-described concave grooves, etc., are not present, and smoothly reaches the foregoing concave grooves, etc. As a result, the aqueous caustic soda solution, etc., is hardly present at the surface of the gas-diffusion cathode other than in the foregoing concave grooves, etc. Thus, the gas-diffusion cathode does not become clogged and the gas supply is not obstructed such that stable electrolysis can be continued at a low voltage.

Figure 2:
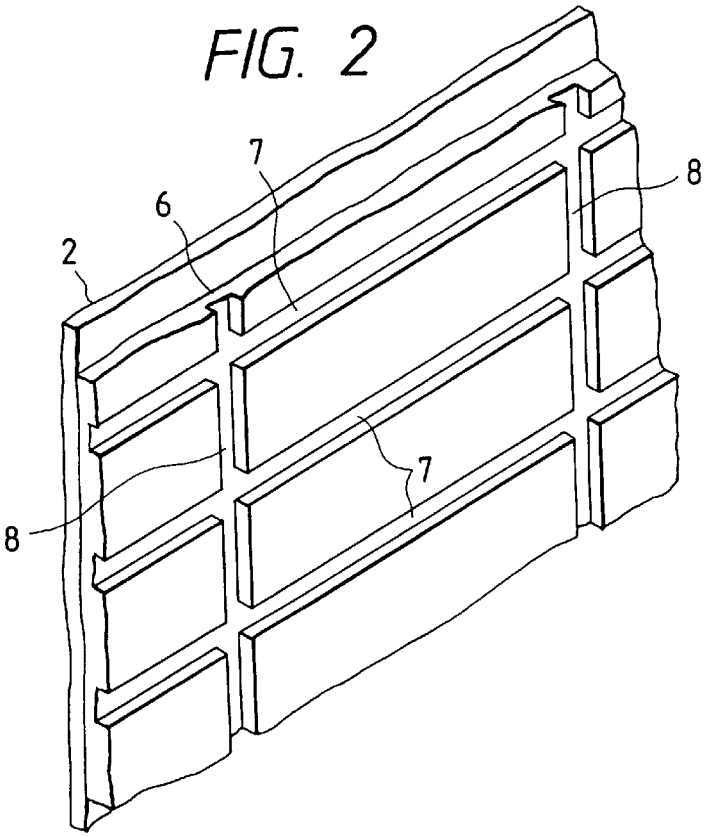
FIG. 2 is an enlarged slant view of the gas-diffusion cathode surface of the present invention at the gas chamber side of FIG. 1.

FIG. 1 is a schematic cross-sectional view showing an embodiment of a two-chamber-type electrolytic cell for soda electrolysis using the gas-diffusion cathode of the present invention. FIG. 2 is an enlarged slant view showing the surface of the gas-diffusion cathode at the gas chamber side.

As shown in FIG. 1, electrolytic cell 1 is partitioned by ion-exchange membrane 2 into an anode chamber 3 and a cathode chamber (gas chamber) 4, a mesh-form insoluble anode 5 is adhered to the foregoing ion-exchange membrane 2 at the anode chamber side 3, and a gas-diffusion cathode 6 is adhered to the ion-exchange membrane 2 at the cathode chamber side 4. On the surface of the gas-diffusion cathode 6 at the cathode chamber side plural horizontal concave grooves 7 are formed at a narrow interval, plural vertical concave grooves 8 are formed at a broader interval crossing the concave grooves 7, and a cathode feeder 9 (FIG. 1) is connected to the gas-diffusion cathode 6. In addition, anolyte inlet 10 is formed at the bottom plate of the anode chamber, 11 is an outlet for the anolyte and gas formed at the upper plate of the anode chamber, 12 is an oxygen gas-containing inlet formed at the upper plate of the cathode chamber, and 13 is an outlet for aqueous caustic soda solution formed at the bottom plate of the cathode chamber.

While supplying an anolyte such as, for example, an aqueous sodium chloride solution to the cathode chamber 3 of the electrolytic cell 1 and supplying an oxygen-containing gas to the cathode chamber 4, an electric current is passed between the electrodes 5 and 6. This causes soda to form at the surface of the ion-exchange membrane facing the cathode chamber side, the caustic soda permeates through the gas-diffusion cathode 6 as an aqueous solution and reaches the surface thereof at the cathode chamber side. The aqueous caustic soda solution reaching the surface flows down on the surface, reaches the horizontal concave groove 7 and is retained in the concave groove 7 or moves along the concave groove 7 in the horizontal direction. The moving aqueous caustic soda solution reaches the cross point with a vertical concave groove 8. Then, the aqueous caustic soda solution successively reaches the lower horizontal concave grooves 7, and as a whole, the aqueous caustic soda solution flows downward and is released from the gas-diffusion cathode. Once the aqueous caustic soda solution reaches the concave grooves 7 or 8, the solution is released from the gas-diffusion cathode without contacting the remaining surface of the gas-diffusion cathode. Thus, the solution does not obstruct gas supply on the remaining electrode surface other than the portions having the concave grooves, and almost the entire surface of the electrode can be effectively used for the electrolysis.

A two-chamber-type electrolytic cell for soda electrolysis is shown in FIG. 1, but the present invention can also be applied to a three-chamber-type electrolytic cell for soda electrolysis, etc.

Figure 3:
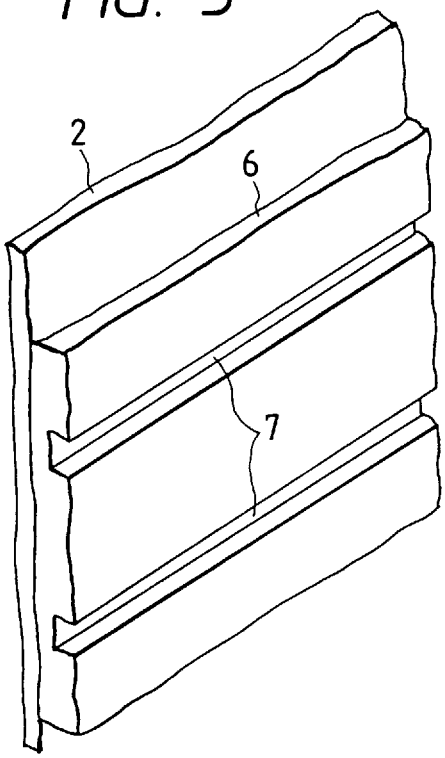
FIG. 3 is an enlarged slant view showing another embodiment of a gas-diffusion cathode surface of the present invention at the gas chamber side.
Figure 4:
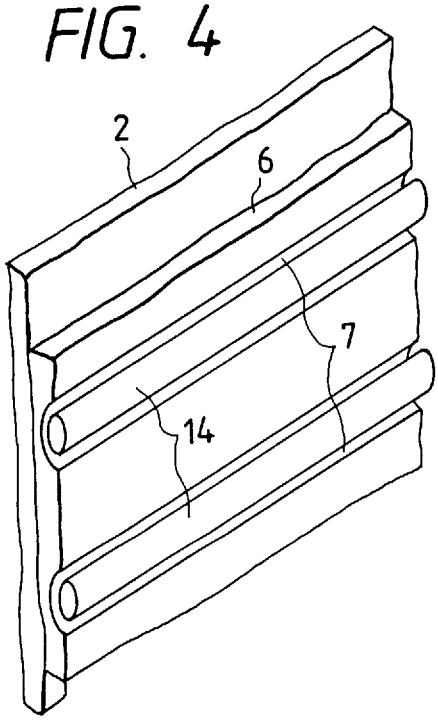
FIG. 4 is an enlarged slant view showing yet another embodiment of a gas-diffusion cathode surface of the present invention.

FIG. 3 is an enlarged slant view showing another embodiment of the surface of the gas-diffusion cathode at the gas chamber side, and FIG. 4 is an enlarged slant view showing yet another embodiment of the gas-diffusion cathode surface.

In the embodiment shown in FIG. 3, only the concave grooves 7 shown in FIG. 2 are formed in the horizontal direction, and concave grooves in the vertical direction are not formed. The aqueous caustic soda solution reaching the surface of the gas-diffusion cathode at the cathode chamber side is retained in the concave grooves 7 or moves along the concave grooves 7 in the horizontal direction, flows down from the end portion of the cathode, and is released from the gas-diffusion cathode.

FIG. 4 shows an embodiment in which metal rods, etc., fill the concave grooves 7 of FIG. 2 in the horizontal direction to form convex portions 14. In this embodiment, as in the case of FIG. 3, the aqueous caustic soda solution reaching the surface of the gas-diffusion cathode at the cathode chamber side moves along the convex portions 14 in the horizontal direction, flows down from the end portions, and is released from the gas-diffusion cathode.

The gas-diffusion cathode of the present invention and electrolysis using this cathode are described in the Examples below, but the present invention should not be construed as being limited thereto.

EXAMPLE 1

A nickel foam thick-plated with silver and having an apparent thickness of 5 mm was crushed by a press to a thickness of 1 mm to form a gas-diffusion electrode base material. A paste formed by adding 5% dextrin as a binder to carbonyl nickel followed by kneading with water was filled in the inside of the above base material from both surfaces thereof and coated on the surfaces thereof. After drying the base material at 60° C., the base material was sintered in an electric furnace at 450° C. for 15 minutes in a hydrogen gas stream. The sintered base material was immersed in a nonelectrolytic plating bath of silver to apply a silver plating to the surfaces.

An aqueous suspension of a PTFE resin, J30 (trade name, made by E. I. Du Pont de Nemours and Company) diluted twice with deionized water was coated on the foregoing plated base materials such that the diluted suspension was applied to both surfaces of the base material and the surfaces of the perforations thereof. After drying, the base material thus coated was sintered at 350° C. for 15 minutes.

One surface of the base material was coated with a suspension obtained by suspending silver powder having an average particle size of 0.2 $\mu$m in an aqueous silver nitrate solution. After drying, the base material was sintered in an hydrogen gas atmosphere at 250° C. for 15 minutes to form an electrode catalyst. On the surface of the base material opposite the coated surface, concave grooves were formed each having a width of 2 mm and a depth of 0.6 mm with an interval of 5 cm in the horizontal direction by a press. Furthermore, concave grooves were formed having the same form as above with an interval of 10 cm in the vertical direction to cross the foregoing horizontal concave grooves.

The base material was used as a gas-diffusion cathode and after connecting the cathode to a cathode feeder composed of a nickel mesh, the gas-diffusion cathode was adhered to the surface of an ion-exchange membrane, Nafion 961 (trade name, made by E. I. Du Pont de Nemours and Company). Then, an insoluble anode prepared by covering a titanium mesh with a mixture of ruthenium oxide and tantalum oxide was adhered to the side of the ion-exchange membrane opposite the foregoing gas-diffusion cathode side, and the insoluble anode and the gas-diffusion cathode were fixed by applying pressure between the above-described cathode feeder and the insoluble anode. The assembly was disposed in a two-chamber-type electrolytic cell having a height of 25 cm and a width of 20 cm to construct an electrolytic cell for soda electrolysis.

While supplying 180 g/liter of an aqueous sodium chloride solution to the anode chamber and oxygen gas saturated with water to the cathode chamber in an amount of 120% of the theoretical amount, electrolysis was carried out at a temperature of 90° C. and a current density of 30 A/dm$^2$.

The initial cell voltage was 2.05 V and an aqueous caustic soda solution having a concentration of 33% was obtained from the cathode chamber. Even after 50 days, the voltage did not change and other performance parameters did not change. Also, the solution on the surface of the foregoing gas-diffusion cathode flowed down along the concave grooves as described above.

Comparative Example 1

The same electrolytic cell was constructed as in Example 1, except that concave grooves were not formed on the surface of the gas-diffusion cathode and the electrolytic production of caustic soda was carried out under the same conditions as in Example 1.

The initial cell voltage was 2.4 V but after 30 minutes, the voltage increased to 2.8 V. When the electric current distribution of the vertical direction of the surface of the gas-diffusion cathode was measured, the current density at a portion 10 cm from the upper end of the electrolytic cell was from 40 to 50 A/dm$^2$, while the electric current at a portion 5 cm from the lower end of the electrolytic cell was almost zero and the generation of a small amount of hydrogen was confirmed. Thus, continuation of the electrolysis was considered to be dangerous and the electrolysis was stopped. In addition, the solution on the surface of the gas-diffusion cathode flowed down along the entire surface of the electrode. At the lowermost portion, the whole surface of the electrode was completely covered with solution which had flowed down the electrode.

EXAMPLE 2

A metal mesh prepared by knitting nickel wires having a diameter of 0.2 mm as the warp and the woof was used as a base material. On one surface of the nickel mesh, nickel wires were arranged each having a diameter of 1 mm in parallel with an interval of 7 cm, and the nickel wires were welded to the nickel mesh. The paste of carbonyl nickel as in Example 1 was coated on both surfaces of the mesh. After drying at room temperature, the base material was sintered in a hydrogen gas atmosphere as in Example 1 to provide an electrode base material. Thus, on one side of the base material the nickel wires projected at a distance of about 0.5 mm.

The surface of the electrode base material having no nickel wire projections was used as the electrode surface, a butyl alcohol solution of chloroauric acid was coated on the electrode surface with a brush and after drying, the base material was heated in a hydrogen gas atmosphere at 200° C. for 15 minutes.

On the nickel wire projected side of the gas-diffusion cathode thus prepared concave grooves were formed having a depth of 0.5 mm and a width of 1 mm in the vertical direction with an interval of 10 cm.

The gas-diffusion cathode thus prepared was mounted in the same electrolytic cell as in Example 1 and electrolysis was carried out under the same conditions as in Example 1. The cell voltage was 2.05 V and was very stable. Also, when the current density was increased to 40 A/dm$^2$, the cell voltage increased to 2.15 V and the amount of the electrolyte formed increased but the electrolysis was stable.

Comparative Example 2

Electrolysis was carried out under the same conditions as in Example 2, except that nickel wires having a diameter of 1 mm were not used and concave vertical grooves were not formed. The initial voltage at a current density of 30 A/dm$_2$ was 2.38 V but after 30 minutes, the voltage increased to over 2.8 V.

As described above, the gas-diffusion cathode of the present invention is a liquid permeation-type gas-diffusion cathode in contact with an ion-exchange membrane partitioning an electrolytic cell into an anode chamber and a cathode gas chamber. Furthermore, plural horizontal concave grooves and/or convex portions are formed in an interval on the surface of the gas-diffusion cathode facing the gas chamber side.

In the gas-diffusion cathode, aqueous caustic soda solution, etc., formed on the surface of the cathode and which permeates to the gas chamber side is retained in the horizontal concave grooves and/or the horizontal convex portions formed on the surface of the cathode facing the gas chamber side or moves along the grooves and/or the convex portions. This prevents the retention of electrolyte such as an aqueous caustic soda solution on those portions of the surface of the gas-diffusion cathode not having the concave grooves and/or the convex portions. Those portions of the electrode surface having the concave grooves and the convex portions cannot be used for electrolysis, but the retention of electrolyte obstructing the gas supply by covering the whole surface of the electrode when the concave grooves, etc., are not present is restrained and the aqueous caustic soda thus formed can be immediately removed from the cathode chamber. As a result, the gas supply and liquid removal can be smoothly carried out, and a lower cell voltage is achieved. That is, in the present invention, the increase in efficiency of the electrolysis obtained by providing the above described concave grooves, etc., sufficiently compensates for the reduction in efficiency due to reduction of the effective electrode surface by providing the concave grooves. Furthermore, even when the amount of the electrolyte formed is increased by increasing the current density, the gas-diffusion cathode is hardly clogged.

In the case of a large-sized electrolytic cell, the release of solution from the surface of the gas-diffusion cathode described above is an important performance parameter, and in the past has been a limiting factor in increasing the size of an electrolytic cell. According to the present invention, when the size of the electrolytic cell is increased, the number of the concave grooves and/or the convex portions is correspondingly increased, and the large amount of solution thus formed can be smoothly released. Thus, the present invention easily allows for scaling up the size of an electrolytic cell.

The method for providing the concave grooves and/or the convex portions on the surface of the gas-diffusion cathode is not particularly limited. For example, concave grooves can be formed by pressing or crushing selected portions of the gas-diffusion cathode, and convex portions can be formed by providing metal wires having good corrosion resistance or by providing wires made of a resin disposed on the gas-diffusion cathode.

In the present invention, in addition to the horizontal concave grooves and/or the convex portions, vertical concave grooves and/or vertical convex portions may be formed which cross the above-described horizontal grooves and/or horizontal convex portions. By employing this construction, the solution flowing along the horizontal concave grooves or horizontal convex portions changes direction to flow downward at a crossing point. The solution then flows along a concave groove or convex portion in the vertical direction, reaches a cross point with a horizontal concave groove or horizontal convex portion below the foregoing horizontal concave groove or horizontal convex portion, and flows along the horizontal concave groove or horizontal convex portion or flows downward along a concave groove or convex portion in the vertical direction to reach the next horizontal concave groove or horizontal convex portion. By repeating the aforesaid steps, the electrolyte on the surface of the gas-diffusion cathode is effectively removed from the cathode surface.

While the invention has been described in detail and with reference to specific embodiments thereof, it will be apparent to one skilled in the art that various changes and modifications can be made therein without departing from the spirit and scope thereof.

What is claimed is:

1. A liquid permeation gas-diffusion cathode in contact with an ion-exchange membrane partitioning an electrolytic cell into an anode chamber and a cathode gas chamber, wherein at least one of plural horizontal concave grooves and horizontal convex portions are provided in an interval with one another on the surface of the cathode facing the gas chamber.

2. The liquid permeation gas-diffusion cathode as in claim 1, wherein said concave grooves comprise crushed portions of the surface of the gas-diffusion cathode.

3. The liquid permeation gas-diffusion cathode as in claim 1, wherein said convex portions comprise wires made of a metal or a resin.

4. A liquid permeation gas-diffusion cathode in contact with an ion-exchange membrane partitioning an electrolytic cell into an anode chamber and a cathode gas chamber, wherein at least one of plural horizontal concave grooves and horizontal convex portions are provided in an interval with one another on the surface of the cathode facing the gas chamber and at least one of plural vertical concave grooves and vertical convex portions are formed on the surface of the cathode in an interval wider than the interval of the horizontal concave grooves or the horizontal convex portions, and said vertical concave grooves or convex portions cross the horizontal concave grooves or convex portions.

5. An electrolytic cell comprising an ion-exchange membrane partitioning the electrolytic cell into an anode chamber and a cathode gas chamber, and a liquid permeation gas-diffusion cathode disposed in said cathode gas chamber having a first surface in contact with said ion-exchange membrane and an opposing second surface facing the cathode gas chamber comprising at least one of plural horizontal concave grooves and horizontal convex portions.

6. The electrolytic cell as in claim 5, wherein said at least one of plural horizontal concave grooves and horizontal convex portions are arranged in an interval with one another.

7. The electrolytic cell as in claim 5, wherein said cathode surface facing the cathode gas chamber comprises plural horizontal concave grooves.

8. The electrolytic cell as in claim 5, wherein said cathode surface facing the cathode gas chamber further comprises at least one of vertical concave grooves and vertical convex portions which cross said at least one of plural horizontal concave grooves and horizontal convex portions.

9. The electrolytic cell as in claim 8, wherein said at least one of plural horizontal concave grooves and horizontal convex portions are arranged in an interval with one another, and said at least one of vertical concave grooves and vertical convex portions are arranged in an interval wider than the interval of the at least one of plural horizontal concave grooves and horizontal convex portions.

* * * * *